US009205959B2

(12) United States Patent
Welk et al.

(10) Patent No.: US 9,205,959 B2
(45) Date of Patent: Dec. 8, 2015

(54) LID FOR TOBACCO CAN

(75) Inventors: Melvin Lee Welk, Petersburg, PA (US); L. Robert McVey, New Providence, PA (US); Gary Howard Caldwell, Denver, PA (US)

(73) Assignee: J.L. Clark, Inc., Rockford, IL (US)

( * ) Notice: Subject to any disclaimer, the term of this patent is extended or adjusted under 35 U.S.C. 154(b) by 1468 days.

(21) Appl. No.: 11/680,333

(22) Filed: Feb. 28, 2007

(65) Prior Publication Data

US 2008/0202956 A1 Aug. 28, 2008

(51) Int. Cl.
*B65D 43/02* (2006.01)
*A24F 23/00* (2006.01)

(52) U.S. Cl.
CPC ..... *B65D 43/0212* (2013.01); *A24F 23/00* (2013.01); *B65D 2543/00092* (2013.01); *B65D 2543/00277* (2013.01); *B65D 2543/00537* (2013.01); *B65D 2543/00629* (2013.01); *B65D 2543/00685* (2013.01); *B65D 2543/00694* (2013.01); *B65D 2543/00731* (2013.01); *B65D 2543/00796* (2013.01); *B65D 2543/00842* (2013.01)

(58) Field of Classification Search
CPC ..... B65D 43/0212; B65D 43/0233; B65D 2543/00796; B65D 2543/00842; B65D 2543/00694
USPC ..... 206/265, 236, 38, 242; 220/310.1, 849, 220/803, 795, 304, 345.6, 804, 806, 378, 220/614, 681, 308, 309.2, 309.1, 620, 288, 220/782
See application file for complete search history.

(56) References Cited

U.S. PATENT DOCUMENTS

| | | | | | |
|---|---|---|---|---|---|
| 649,979 | A | * | 5/1900 | Danz | 220/309.1 |
| 1,338,089 | A | * | 4/1920 | Nelson | 131/359 |
| 1,375,384 | A | * | 4/1921 | Guhl | 220/9.2 |
| 1,489,950 | A | * | 4/1924 | Kronquest | 220/803 |
| 1,519,137 | A | * | 12/1924 | Hothersall | 206/265 |
| 2,025,470 | A | * | 12/1935 | Miller | 229/5.5 |
| 2,047,951 | A | * | 7/1936 | Eberhart | 220/377 |
| 2,275,426 | A | * | 3/1942 | Gray | 220/284 |
| 2,384,810 | A | * | 9/1945 | Calleson et. al. | 220/658 |

(Continued)

FOREIGN PATENT DOCUMENTS

| | | | |
|---|---|---|---|
| DE | 20 2004 007 079 | U1 | 8/2004 |
| DE | 20 2004 007 079 | U1 | 12/2004 |

(Continued)

OTHER PUBLICATIONS

U.S. Appl. No. 12/168,244, filed Jul. 7, 2008, Cronin et al.

(Continued)

*Primary Examiner* — Andrew Perreault
(74) *Attorney, Agent, or Firm* — Reinhart Boerner Van Deuren P.C.

(57) ABSTRACT

A metal lid for a tobacco can is provided. The metal lid includes a circular lid top having a central recess and a shoulder. The shoulder extends radially outwardly from and vertically above the central recess. The side wall is unitarily formed with the shoulder, depends downwardly from the shoulder, and is disposed below the central recess of the lid top. The side wall includes a bead and a hem. The bead extends circumferentially around the side wall. The hem is formed from a distal portion of the side wall folded over onto an intermediate portion of the side wall. The hem functions as a guide, forms a safety edge, and permits the lid to be more easily grasped by a consumer.

26 Claims, 4 Drawing Sheets

(56) References Cited

U.S. PATENT DOCUMENTS

| | | | | | |
|---|---|---|---|---|---|
| 2,415,609 | A | * | 2/1947 | Sebell | 215/256 |
| 2,551,615 | A | * | 5/1951 | Maher | 220/310.1 |
| 2,849,146 | A | * | 8/1958 | Wigert | 220/296 |
| 2,864,528 | A | * | 12/1958 | Henchert | 220/806 |
| 3,074,548 | A | * | 1/1963 | Parks | 206/524.3 |
| 3,240,383 | A | * | 3/1966 | Scholtz | 220/203.09 |
| 3,411,650 | A | * | 11/1968 | Mumford | 215/347 |
| 3,596,828 | A | * | 8/1971 | Foster et al. | 206/264 |
| 3,687,334 | A | | 8/1972 | McNeil | |
| 3,721,365 | A | * | 3/1973 | Saunders | 220/260 |
| 4,052,234 | A | | 10/1977 | Yamagishi et al. | |
| 4,098,421 | A | | 7/1978 | Foster | |
| 4,190,170 | A | | 2/1980 | Boyd | |
| 4,202,462 | A | * | 5/1980 | Imber | 220/293 |
| 4,442,971 | A | | 4/1984 | Helms | |
| 4,513,872 | A | * | 4/1985 | Bull | 220/310.1 |
| 4,646,933 | A | | 3/1987 | Jurczenia et al. | |
| 5,979,688 | A | * | 11/1999 | Stodd | 220/231 |
| 6,206,220 | B1 | * | 3/2001 | Stodd | 220/231 |
| 6,652,990 | B2 | * | 11/2003 | Carey et al. | 206/524.3 |
| D494,474 | S | | 8/2004 | Pace et al. | |
| D499,025 | S | | 11/2004 | Houk et al. | |
| D510,524 | S | | 10/2005 | Houk et al. | |
| D512,636 | S | | 12/2005 | Pace | |
| D513,386 | S | | 1/2006 | Pace et al. | |
| D514,936 | S | | 2/2006 | Pace et al. | |
| D515,426 | S | | 2/2006 | Pace et al. | |
| D515,429 | S | | 2/2006 | Pace | |
| D515,439 | S | | 2/2006 | Pace | |
| D515,928 | S | | 2/2006 | Pace | |
| D523,752 | S | | 6/2006 | Bried et al. | |
| D563,786 | S | | 3/2008 | Welk et al. | |

FOREIGN PATENT DOCUMENTS

| | | |
|---|---|---|
| DE | 202006016010 U1 | 2/2007 |
| EP | 0 219 297 | 1/1991 |
| FR | 1 565 966 | 5/1969 |
| GB | 246277 | 1/1926 |

OTHER PUBLICATIONS

U.S. Appl. No. 29/320,885, filed Jul. 7, 2008, Cronin.
U.S. Appl. No. 29/320,880, filed Jul. 7, 2008, Cronin.

* cited by examiner

LID FOR TOBACCO CAN

FIELD OF THE INVENTION

This invention generally relates to lids for containers and, more particularly, to a lid for a tobacco can.

BACKGROUND OF THE INVENTION

Loose tobacco and related tobacco products are typically packaged and sold in disc-shaped containers. In many cases, the containers comprise a metal lid seated upon either a metal, plastic or cardboard can. Often, a band-type label is adhesively secured over the seam between the lid and can to securely fasten the lid and the can. The band type label also typically will positively impact the freshness of the product. The label also typically includes print, images, and information regarding the tobacco product for a potential customer.

Conventionally, the lid includes a relatively flat top cover portion and a surrounding skirt. The skirt terminates in a cut edge. Considering that lids are often formed from metal (plastic lids are also common), a metal edge has the potential to be relatively sharp. If the sharp edges are not properly made smooth, a purchaser of the container may potentially risk suffering a laceration in one of their fingers when prying the lid from the can using the edges. The interface between the can and the lid typically will have a snap fit to facilitate removal and attachment of the lid and the can. The interface between the lid and the can affects breathability and therefore freshness of the tobacco product contained therein. Thus, the interface between the lid and the can include multiple configurations. The present invention is directed towards improvements over the state of the art.

BRIEF SUMMARY OF THE INVENTION

A lid for a tobacco can is provided. The bottom edge of the lid includes a formed hem instead of a free cut edge. The hem extends outwardly further than a contact point disposed on a bead of a side wall such that the hem functions as a guide when placing the lid onto the can.

In one embodiment, a metal lid for a tobacco can is provided. The metal lid includes a circular lid top, a circumferential shoulder, and a circumferential side wall. The circumferential shoulder is unitarily formed with the lid top and extends radially outwardly from and vertically above the lid top. The circumferential side wall is unitarily formed with the shoulder, depends downwardly from the shoulder, and is disposed below the lid top. The side wall includes a bead and a hem. The bead extends circumferentially around the side wall. The hem is formed from a distal portion of the side wall folded over onto an intermediate portion of the side wall.

In another embodiment, a metal lid for a non-metallic tobacco can is provided. The metal lid includes a lid top, a circumferential shoulder unitarily formed with the lid top, and a circumferential side wall unitarily formed with and depending from the shoulder. The side wall includes a bead and a hem. The hem is formed by a distal portion of the side wall folded adjacent to an intermediate portion of the side wall. The bead progresses around the side wall and projects radially inwardly toward the lid top further than the hem such that when the bead seats against the tobacco can the hem is spaced apart from the tobacco can.

In yet another embodiment, the invention provides a lid for a non-metallic can. The lid includes a unitary lid body formed from metal. The lid body includes a round lid top, a shoulder, and a side wall. The shoulder extends circumferential around and radially outwardly and upwardly away from the lid top. The side wall depends downwardly from the shoulder and away from the lid top. A portion of the side wall is folded inwardly onto itself to form a hem in a lower portion of the side wall.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
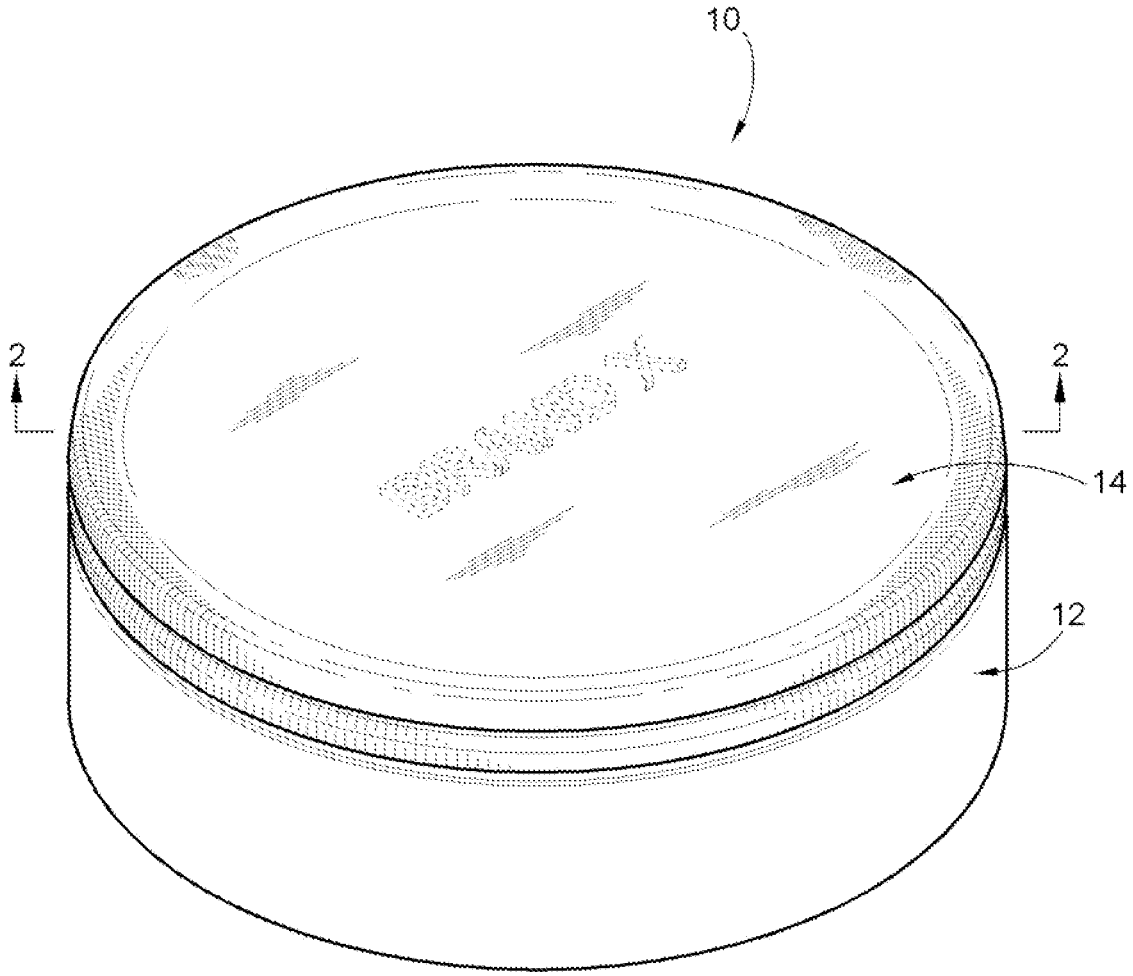
FIG. 1 is a top and front perspective view of an exemplary embodiment of a lid for a tobacco can in accordance with the teachings of the present invention.

Referring to FIG. 1, a container 10 is illustrated. The container 10 is typically employed to house chewing tobacco or other goods suitable for retail purchase by a consumer. In that regard, the container 10 has an overall size that allows a consumer to comfortably hold the container within the palm of a hand and to store the container within a shirt pocket or in the rear pocket of a pair of blue jeans. Typically the size for facilitating these tobacco container functions is approximately 2½ inches in diameter and approximately 1 inch in axial thickness.

The container 10 may include features that make the container more aesthetically pleasing such as, for example, color, images or prints, labels, embossing, and the like. The container 10 may also be secured together by, for example, a band-type adhesive label during a packaging process. After the label has been broken, the container 10 may be repeatedly opened and closed such that the consumer may access, as often as desired, a chosen amount of the contents stored in the container 10.

As shown in FIG. 1, the container 10 is formed when a generally cylindrical tobacco can 12 (a.k.a., cup or base) receives a generally cylindrical lid 14 (a.k.a., cover). The can 12 is suitably formed from a variety of different materials, or combinations thereof, such as metal, plastic, cardboard, and the like. In the illustrated embodiment of FIG. 2, the can 12 is formed from plastic. The plastic of the can 12 may be either transparent, translucent, or opaque depending on the desired use of the container 10 and whether the contents, or lack of contents, within the container are to be externally viewable.

Figure 2:
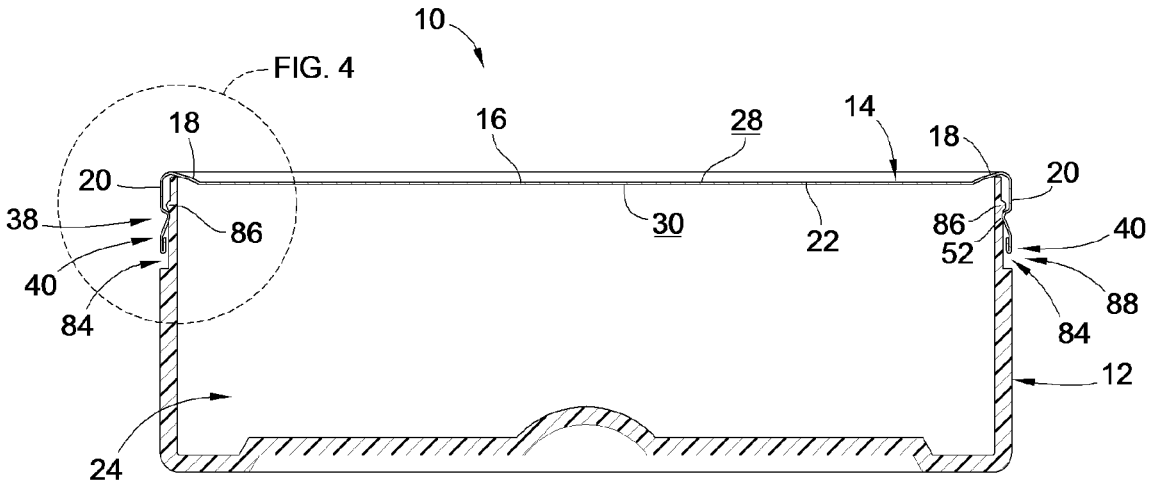
FIG. 2 is a cross section view of the lid of FIG. 1 taken generally along line 2-2.

Still referring to FIG. 2, in the illustrated embodiment the lid 14 is formed from a relatively thin piece of metal (e.g., sheet metal). As shown, the lid 14 includes a circular lid top 16 and a skirt in the form of a cylindrical side wall 20. The juncture of the skirt and the lid top 16 forms a shoulder 18 that may provide an upper annular recessed pocket for receiving the upper end of the can In the illustrated embodiment, the lid top 16, shoulder 18, and side wall 20 form a unitary lid body 22. As shown in FIG. 2, when the lid 14 is positioned or seated upon the can 12, an enclosed storage cavity 24 is defined within the container 10. The storage cavity 24 is where the tobacco products are held until removed by the consumer.

Figure 3:
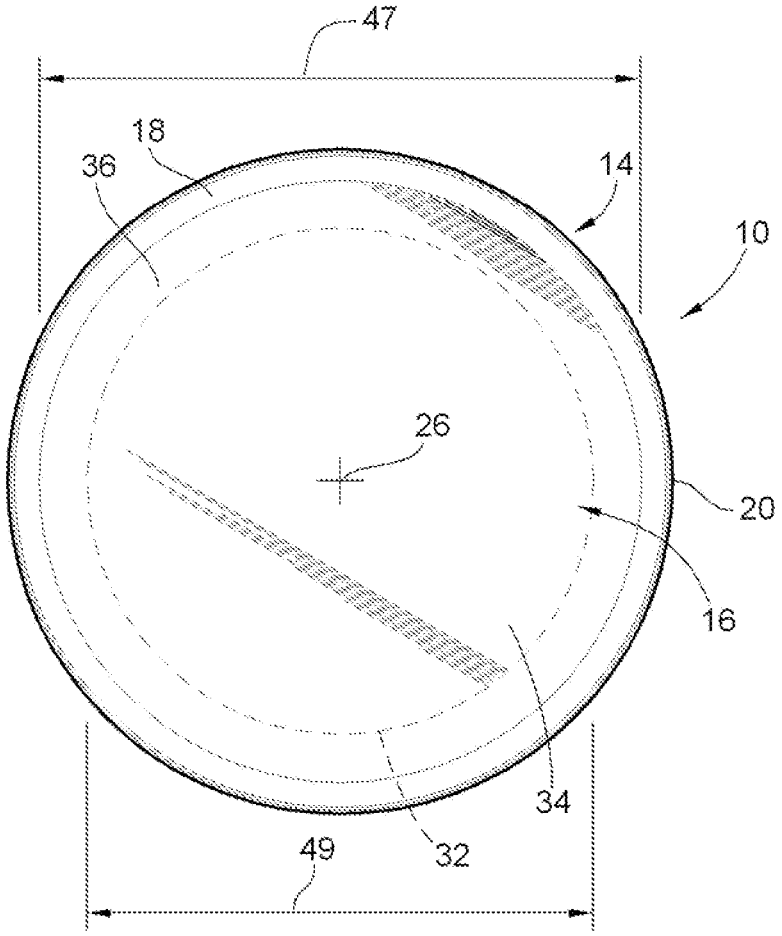
FIG. 3 is a top plan view of the lid of FIG. 1.

As depicted in FIG. 3, because the lid top 16 and the overall lid 14 are both generally circular in shape, they define and share a common center point 26. The lid top 16 generally extends radially outwardly from the center point 26 between about one inch and about one and half inches. Therefore, the lid top 16 has a diameter 47 of between about two inches and about three inches. In the illustrated embodiment of FIG. 2, the diameter 47 of the lid top 16 is about 2.3 inches.

Referring back to FIG. 2, the lid top 16 includes both a top and bottom surface 28, 30 (i.e., exterior and interior surface) facing in opposing directions. As the lid is formed from sheet metal, the top and bottom surfaces 28, 30 are parallel to each other such that the lid top 16 may be considered generally planar or flat. Although not shown, the lid top 16 may include embossed letters, numbers, images, and the like (collectively "characters"). The embossed characters may project upwardly away from the can 12 or fall downwardly into the storage cavity 24. In that regard, the embossed characters either have a height or depth of about 0.015 of an inch or less.

In the illustrated embodiment of FIG. 3, any embossed characters formed on the lid top 16 are situated radially inward of an embossing limit 32 (represented by a dashed line) and within an embossing portion 34 of the lid top. As shown, the embossing limit 32 generally extends radially outwardly from the center point 26 of the lid top 16 about half an inch to about one inch. Therefore, a diameter 49 of the embossing limit 32 is about one inch to about two inches. In the illustrated embodiment of FIG. 3, the diameter 49 of the embossing limit 32 is 1.85 inches.

Still referring to FIG. 3, in the illustrated embodiment an annular non-embossed flat portion 36 of the lid top 16 separates the shoulder 18 and the embossing portion 34. The purpose of this flat non-embossed portion 36 is to facilitate proper beading and hemming operations of the lid skirt within tight tolerances during metal forming operations for proper interface, snap-fit and freshness functions. The inside diameter of the annular flat portion 36 is spaced apart from the center point 26 of the lid top 16 between about ¾ inch and about 1¼ inches.

Figure 4:
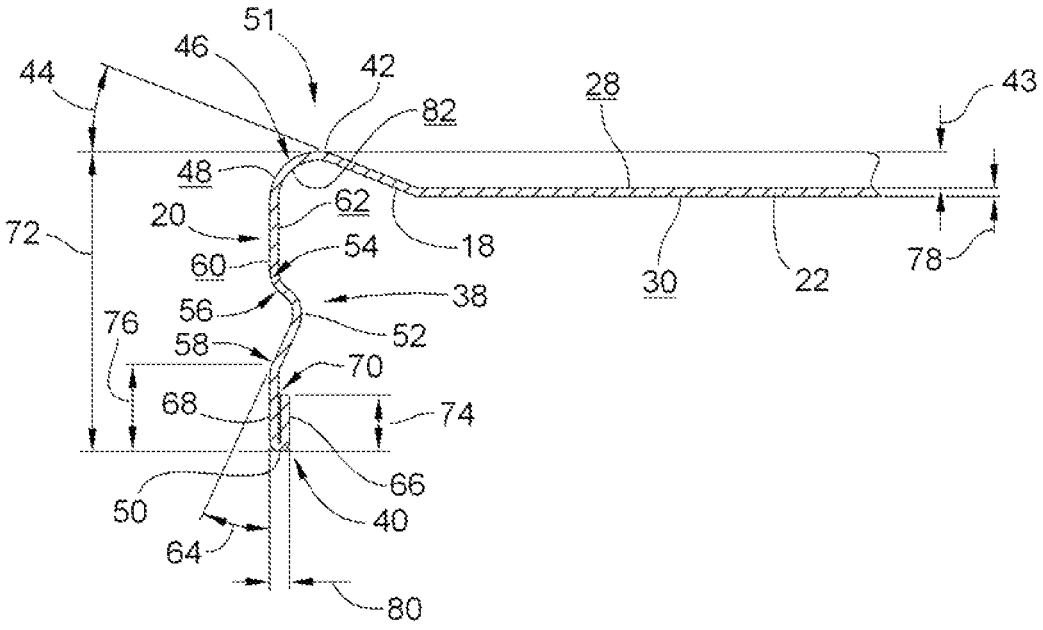
FIG. 4 is an enlarged portion of the lid of FIG. 2 highlighting a bead and a hem in a side wall of the lid.

Moving to FIG. 4, the shoulder 18 is unitarily formed with the lid top 16 (see FIG. 3). The shoulder 18 extends radially outwardly from the lid top 16 between about 0.1 of an inch and about 0.2 of an inch. In the illustrated embodiment, the shoulder 18 has a radial dimension or width of between about 0.245 inch, but may be between about 0.2 of an inch and about 0.3 of an inch.

In addition to extending radially outwardly from the lid top 16, the shoulder 18 also projects vertically upwardly from a circular recess in the lid top (e.g., from the flat non-embossed portion 36). From the recessed flat center portion of the lid top 16, the shoulder 18 projects a shoulder height 43 of between about 0.01 of an inch and about 0.04 of an inch. In the illustrated embodiment, an apex 42 of the shoulder 18 is about 0.03 of an inch above the top surface 28 of the lid top 16 and the conical wall along the top surface of the shoulder 18 forms an angle 44 of about twenty-two degrees relative to the top surface 28 of the lid top 16.

As shown, the shoulder 18 also includes a round or radiused corner 46 to facilitate a transition between the lid top 16 and the side wall 20. The side wall 20 extends downward generally perpendicular to the lid top 16. The corner 46 in the illustrated embodiment has a radius of curvature 51 of about 0.039 of an inch relative to an outer surface 48 of the corner. The radius of curvature 51 of the corner 46 may generally be between about 0.03 of an inch and about 0.05 of an inch.

The side wall 20 extends circumferentially around the shoulder 18 and, as oriented in FIG. 4, extends downwardly from the shoulder. The side wall 20 of the lid 14 includes both the bead 38 and the hem 40. Like the lid top 16, the side wall 20 is also unitarily formed with shoulder 18. As shown, the bead 38 is generally interposed between the hem 40 and the shoulder 18. The bead 38 projects radially inwardly toward the center point 26 of the lid top 16 (see FIG. 3).

The bead 38 progresses circumferentially and continuously around the entire side wall 20 of the lid 14. Therefore, as the bead 38 extends around the lid 14, the bead is unbroken and uninterrupted. Even so, in another embodiment the bead 38 may be intermittently formed such that the side wall 20 is, at discrete locations, planar all the way from beneath the corner 46 of the shoulder 18 to just above a bottom 50 of the hem 40. In such embodiments, a thin column or portion of the side wall 20 is not bowed inwardly and instead appears flat when viewed from outside the container 10.

An innermost inflection/contact point 52 of the bead 38, which is intended to contact the can 12 when the lid 14 is seated upon the can (as shown in FIG. 1), is vertically disposed below the apex 42 of the shoulder 18 between about 0.1 of an inch and about 0.2 of an inch. In the illustrated embodiment, the contact point 52 is 0.134 of an inch below the apex 42 with a preferred tolerance of about 0.008 of an inch. Also, the bead 38 projects radially inwardly toward the lid top 16 between about 0.02 of an inch and about 0.05 of an inch.

Still referring to FIG. 4, in the illustrated embodiment the bead 38 is formed to include radii of curvature 54, 56, 58. In the illustrated embodiment, the radius of curvature 56 is different than the other radii of curvature 54, 58. Therefore, the bead 38 has an asymmetrical cross section as shown in FIG. 4. The first, second and third radii of curvature 54, 56, 58 are between about 0.02 of an inch and about 0.03 of an inch relative to an external side wall surface 60. In the illustrated embodiment, the first radius of curvature 54 is 0.024 of an inch, the second radius of curvature 56 is 0.026 of an inch, and the third radius of curvature 58 is 0.024 of an inch.

The hem 40 is generally a distal portion 66 of the side wall 20 folded inwardly adjacent an intermediate portion 68 of the side wall. In other words, the distal portion 66 is curled inwardly toward the lid top 16 to be in contact or almost contact with the inner surface of the remainder of the side wall 20. In the illustrated embodiment, the distal portion 66 and the intermediate portion 68 are illustrated slightly spaced apart from each other to form channel 70 between the two portions of the side wall. In the illustrated embodiment, because the hem 40 is a folded piece of metal, the hem generally need not be smoothed, ground, buffed, or otherwise machined to eliminate the terminating cut edge. The hem 40 naturally possesses a bottom 50 that is rounded and smooth. By creating a safety edge at the bottom 50 of the lid 14 through folding instead of otherwise machining as noted above, the lid may be more quickly, easily, and cost-effectively fabricated.

As shown in FIG. 4, the lid 14 has a vertical height 72, which is measured between the apex 42 of the shoulder 18 and the bottom 50 of the hem 40, of between about 0.1 of an inch and about 0.5 of an inch. In the illustrated embodiment, the vertical height 72 is 0.247 of an inch with a tolerance of 0.005 of an inch.

The distal portion 66 of the side wall 20 has a height 74 of between about 0.04 of an inch and about 0.05 of an inch. In the illustrated embodiment, the height 74 of the distal portion 66 is 0.046 of an inch. To ensure that formation of the hem 40 does not interfere with or damage the bead 38, the height 74 of the distal portion 66 is generally less than a height 76 of the intermediate portion 68.

In the illustrated embodiment, the lid body 22 is formed entirely from electrolytic tin plate having a thickness 78 of between about 0.005 of an inch and about 0.009 of an inch. In FIG. 4, the thickness 78 is 0.0072 of an inch. In other words, the thickness 78 is approximately 0.008 of an inch. As such, the hem 40, which is two portions of the lid body 22 folded over, has a hem thickness 80 of between about 0.010 of an inch and 0.018 of an inch. Again, in the illustrated embodiment the hem thickness 80 is 0.016 of an inch.

In the illustrated embodiment of FIG. 4, the bottom surface 30, the internal side wall surface 62, and an internal shoulder surface 82 (collectively "interior surfaces") of the lid top 16, the side wall 20, and the shoulder 18, respectfully, are coated with a gold phenolic finish. Even so, in other embodiments other types of coatings or finishes may be applied to, or formed on, these interior surfaces.

Referring now to both FIGS. 2 and 4, the contact point 52 of the bead 38 projects radially inwardly toward the lid top 16 and the can 12 further than the hem 40. As such, when the lid 14 has been secured upon the can 12 as shown in FIG. 2, the contact point 52 and the can 12 are in direct contact and engaged with each other while a gap 84 is formed between the hem 40 and the can 12. The gap 84 is generally between about 0.005 of an inch and 0.015 of an inch. In the illustrated embodiment, the gap 84 is approximately 0.010 of an inch.

The gap 84 permits the hem 40, which is spaced radially outwardly further than the contact point 52 of the bead 38, to function as a guide when fitting the lid 14 onto the can 12. The guide allows the lid 14 to be oriented relative to the can 12 such that the two parts can be telescopically coupled together to form the container 10 and hold the product. In addition, the gap 84 enables the consumer to better grasp or grab the lid 14, particularly the bottom 50 of the hem 40, with their fingers when separating the lid 14 from the can 12.

Referring to FIG. 2, in the illustrated embodiment the can 12 includes an outwardly projecting circumferential rib 86. To secure the lid 14 to the can 12, the lid is biased downwardly until the contact point 52 of the bead 38 slips past the rib 86 on the can. To separate the lid 14 from the can 12, the lid is biased upwardly until the contact point 52 of the bead 38 slides over the rib 86. Once the bead 38 is vertically above the rib 86 as oriented in FIG. 4, the lid 14 may be freely lifted clearly of the can 12 without further interference.

When the lid 14 is biased upwardly as described above, the consumer may be able to secure a hold on the bottom 50 of the hem 40 to make the task of removing the lid easier. When the lid 14 is removed from the can 12, the consumer is able to remove a desired amount of the contents of the container 10 from the storage cavity 24. The process of securing the lid 14 to the can 12 and removing the lid from the can may be repeated as often as access to the contents of the storage cavity 24 is desired.

In an alternative embodiment, the container 10 may include vertical ribs (not shown) or other structure to aid or assist in the venting of the container when the lid 14 is removed from and placed upon the can 12. One example of this type of venting structure is disclosed in U.S. Pat. No. 4,098,421 to Foster, which is incorporated herein in its entirety by this reference thereto for this reason.

When the lid 14 and the can 12 are engaged together as shown in FIG. 2, the seam 88 that forms between the lid and the can may be covered or hidden by a label (not shown) or other packaging material. For example, a band-type label may be adhesively secured to portions of the lid 14 and the can 12 adjacent to the seam 88 such that the label covers the seam. Until the label is split or broken by the consumer using a knife, fingernail, or other sharp object, the seam 88 remains hidden and the label inhibits moisture from entering the storage cavity 24, in conjunction with the snap fit interface. As such, the product held within the storage cavity 24 remains fresh.

From the foregoing, those skilled in the art will recognize that the lid 14 for the tobacco can 12 has a rounded hem 40 that is both safe and easy to grasp. The hem 40, being spaced outwardly further than the bead 38, also helps to guide the lid 14 onto the can 12 when they are operably coupled together.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A metal lid for a tobacco can, comprising:

a circular lid top including a central recess and a shoulder, the shoulder extending radially outwardly from and vertically above the central recess; and a circumferential side wall unitarily formed with the lid top at the shoulder, the side wail depending downwardly from and disposed below the central recess of the- lid top, the side wall including a bead and a hem, the bead extending circumferentially around the side wall, the hem formed from a distal portion of the side wall folded over onto an intermediate portion of the side wall, wherein the distal and intermediate portions of the sidewall forming the hem are generally parallel to one another;

wherein the distal portion of the side wall forming the hem is folded inwardly toward the central recess;

wherein the bead projects inwardly toward the central recess further than the distal portion of the hem such that the lid is adapted to be repeatedly manually pressed onto and removed from the tobacco can with the bead resiliently snapping into engagement with an annular rib of the can to secure the lid to the can; and wherein a thickness of the hem is between about 0.01 of an inch and about 0.02 of an inch such that the hem will not interfere with the annular rib of the can when the lid is repeatedly pressed onto and removed from the can and a height of the hem is between about 0.04 of an inch and about 0.05 of an inch, the height being less than a height of the intermediate portion such that the hem does not interfere with the bead.

2. The metal lid of claim 1, wherein the intermediate portion extends generally parallel to a center axis of the lid, and the distal portion is in contact with or almost in contact with the intermediate portion.

3. The metal lid of claim 1, wherein an interior surface of at least one of the lid top, the shoulder, and the side wall are coated with a gold phenolic finish.

4. The metal lid of claim 1, wherein an annular portion of the lid top is spaced apart from a center point of the lid top between about 0.75 of an inch and about 1.25 inches and flat in order to support bead and hem formation.

5. The metal lid of claim 1, wherein the bead projects inwardly toward the central recess further than the distal portion of the hem to define a snap fit wherein the lid is adapted to be repeatedly manually pressed onto and removed from the tobacco can with the bead resiliently snapping onto the annular rib of the tobacco can.

6. A metal lid for a tobacco can, comprising:

a circular lid top including a central recess and a shoulder, the shoulder extending radially outwardly from and vertically above the central recess; and a circumferential side wall unitarily formed with the lid top at the shoulder, the side wall depending downwardly from and disposed below the central recess of the lid top, the side wall including a bead and a hem, the bead extending circumferentially around the side wall, the hem formed from a distal portion of the side wall folded over onto an intermediate portion of the side wall, wherein the distal and intermediate portions of the sidewall forming the hem are generally parallel to one another;

wherein the distal portion of the side wall forming the hem is folded inwardly toward the central recess; and wherein an embossing portion of a top surface of the lid top extends radially outwardly from a center point of the lid top up to about one inch, the embossing portion projecting above the top surface between about 0.01 of an inch and about 0.02 of an inch.

7. A metal lid for a tobacco can, comprising:

a circular lid top including a central recess and a shoulder, the shoulder extending radially outwardly from and vertically above the central recess; and a circumferential side wall unitarily formed with the lid top at the shoulder, the side wall depending downwardly from and disposed below the central recess of the lid top, the side wall including a bead and a hem, the bead extending circumferentially around the side wall, the hem formed from a distal portion of the side wall folded over onto an intermediate portion of the side wall, wherein the distal and intermediate portions of the sidewall forming the hem are generally parallel to one another;

wherein the distal portion of the side wall forming the hem is folded inwardly toward the central recess; and wherein the bead projects inwardly toward the lid top between about 0.02 of an inch and about 0.05 of an inch, wherein the lid is adapted to be manually repeatedly pressed onto and removed from the tobacco can with the bead resiliently snapping into engagement with an annular rib of the tobacco can to secure the lid to the can.

8. The metal lid of claim 7, wherein the bead intermittently circumferentially extends around the side wall.

9. The metal lid of claim 7, wherein an outer diameter of the metal lid is between about two inches and about three inches and a vertical height of the metal lid measured between an apex of the shoulder and a bottom of the hem is between about one tenth of an inch and about half an inch whereby the metal lid is configured for a hand held pocket size smokeless tobacco container.

10. A metal lid for a tobacco can comprising:

a circular lid top including a central recess and a shoulder, the shoulder extending radially outwardly from and vertically above the central recess; and a circumferential side wall unitarily formed with the lid top at the shoulder, the side wall depending downwardly from and disposed below the central recess of the lid top, the side wall including a bead and a hem, the bead extending circumferentially around the side wall, the hem formed from a distal portion of the side wall folded over onto an intermediate portion of the side wall, wherein the distal and intermediate portions of the sidewall forming the hem are generally parallel to one another;

wherein the distal portion of the side wall forming the hem is folded inwardly toward the central recess; and wherein an apex of the shoulder is rounded and extends above a top surface of the central recess between about 0.2 of an inch and 0.04 of an inch.

11. A tobacco container, comprising:

a tobacco can including an annular can sidewall, the can sidewall including a radially outward extending rib; and a lid comprising:

a lid top including a recessed portion and a circumferential shoulder; and a circumferential side wall unitarily formed with and depending from the shoulder, the side wall including a bead and a hem, the hem formed by a distal portion of the side wall folded radially inward and adjacent to an intermediate portion of the side wall, the bead progressing around the side wall and projecting radially inwardly toward the lid top further than the hem such that when the bead seats against the tobacco can in engagement with the radially outward extending rib to secure the lid to the tobacco can, the hem is spaced apart from the tobacco can; and wherein the distal portion is between about 0.02 of an inch and about 0.06 of an inch and folded inwardly toward the lid top and a gap formed between the hem and the can sidewall of the tobacco can when the lid is secured to the tobacco can is between about 0.005 of an inch and about 0.015 of an inch.

12. The tobacco container of claim 11, wherein the hem on the side wall functions as a guide when fitting the metal lid onto the tobacco can due to the hem being disposed radially outwardly of the bead.

13. The tobacco container of claim 11, wherein the bead is non-symmetrical in axial cross section and the distal portion directly contacts the intermediate portion.

14. The tobacco container of claim 11, wherein only a single fold is provided between the intermediate portion and a terminating free end of the sidewall, the single fold directly connecting the intermediate portion with the distal portion of the sidewall such that the terminating free end axially faces the bead and axially away from the single fold.

15. The tobacco container of claim 11, further comprising tobacco stored therein.

16. A container of tobacco, comprising:

a can including an annular can sidewall extending from a side of a bottom, the can sidewall including a radially outward extending rib, the radially outward extending rib having an outer diameter;

a lid comprising:

a unitary lid body formed from metal, the lid body including a round lid top, a shoulder, and a side wall, the shoulder extending circumferential around and radially outwardly and upwardly away from a central recess of the lid top, the side wall depending downwardly from the shoulder and away from the central recess of the lid top, a hem formed from a distal portion of the side wall folded to be substantially parallel to an intermediate portion of the side wall, the hem having an inner diameter; and wherein the side wall further includes a bead formed between the shoulder and the hem, the bead projecting radially inwardly further than the hem, the bead releasably engaging the radially outward extending rib for releasably securing the lid to the can;

the inner diameter of the hem being greater than the outer diameter of the radially outward extending rib to prevent interference between the hem and the radially outward extending rib during repeated opening and closing of the tobacco container;

the hem being dimensioned such that the hem does not engage the can when the lid is secured to the rib; and tobacco stored within the can.

17. The container of tobacco of claim 16, wherein only a single fold is provided between the intermediate portion and a terminating free end of the sidewall, the single fold directly connecting the intermediate portion with the distal portion of the sidewall such that the terminating free end axially faces the bead and axially away from the single fold.

18. The container of tobacco of claim 16, wherein a gap is formed between the intermediate portion and the distal portion.

19. A tobacco container storing tobacco comprising:

a can including an annular can sidewall extending from a side of a bottom, the can sidewall including a radially outward extending rib;

a metal lid comprising:

a lid top including a recessed portion and a circumferential shoulder; and a circumferential side wall unitarily formed with and depending from the shoulder, the side wall including a bead and a hem, the hem formed by a distal portion of the side wall folded radially inward and adjacent to an intermediate portion of the side wall, the distal and intermediate portions of the sidewall being generally parallel to one another, the bead progressing around the side wall and projecting radially inwardly toward the lip top further than the hem such that when the bead seats against the can the hem is spaced apart from the can forming a radial gap therebetween such that the hem does not engage the can when the lid is mounted to the can, the bead axially engaging the rib to axially releasably secure the lid to the can;

an interior surface of the metal lid having a coating thereon;

the can sidewall having a stepped portion, the lid and canforming a seam axially between the hem and the stepped portion when the lid is releasably secured to the can, the seam being an axial gap formed between the hem and the stepped portion;

a band-type label adhesively secured to a portion of the lid and a portion of the can and over lapping the seam;

wherein the tobacco container has a maximum outer diameter of between about 2 inches and 3 inches whereby the medal lid is configured for a hand held pocket size tobacco container sized to be held in the palm of the hand;

wherein an outer diameter of the portion of the lid directly adjacent the seam and an outer diameter of the portion of the portion of the lid adjacent the seam are substantially equal allowing the band-type label to be adhesively secured to the portion of the lid and the portion of the can as the band-type label over laps the seam; and tobacco stored within the can; and wherein the distal portion is between about 0.02 of an inch and about 0.06 of an inch and folded inwardly toward the lid top and the radial gap formed between the hem and the can is between about 0.005 of an inch and about 0.015 of an inch.

20. The tobacco container of claim 19, wherein the intermediate portion extends generally parallel to a center axis of the lid, and the distal portion is radially spaced from the intermediate portion.

21. The tobacco container of claim 19, wherein only a single fold is provided between the intermediate portion and a terminating free end of the sidewall, the single fold directly connecting the intermediate portion with the distal portion of the sidewall of the lid such that the terminating free end axially faces the bead and axially away from the single fold, such that the hem is formed solely by two parallel portions of the sidewall of the lid connected by the single fold.

22. The tobacco container of claim 21, wherein the terminating free end of the sidewall is spaced axially apart from the bead such that the bead is positioned axially between the terminating free end and the entire lid top exposing the terminating free end to the interior of the lid when the lid is removed from the can such that the terminating free end faces the lid top.

23. The tobacco container storing tobacco of claim 19, wherein an interface between the can and metal lid is configured to provide breathability between the metal lid and can when the metal lid is attached to the can.

24. The tobacco container storing tobacco of claim 19, wherein an inner diameter of the hem is greater than an outer diameter of the radially outward extending rib to prevent interference between the hem and the radially outward extending rib during repeated manual attachment of the metal lid to and removal of the metal lid from the can.

25. The tobacco container storing tobacco of claim 24, wherein the hem provides a guide when fitting the metal lid onto the can due to the hem being disposed radially outwardly of the bead and because the hem does not interfere with the radially outward extending rib.

26. The tobacco container storing tobacco of claim 19, wherein the hem, bead and radially outward projecting rib are configured for a snap fit such that the tobacco container may be repeatedly manually opened and closed.

* * * * *

UNITED STATES PATENT AND TRADEMARK OFFICE

CERTIFICATE OF CORRECTION

PATENT NO. : 9,205,959 B2
APPLICATION NO. : 11/680333
DATED : December 8, 2015
INVENTOR(S) : Melvin Lee Welk et al.

It is certified that error appears in the above-identified patent and that said Letters Patent is hereby corrected as shown below:

In the Claims

Column 6, Line 63
The word "wail" should correctly read "wall".

Column 6, Line 64
The word "the-" should correctly read "the".

Column 10, Line 2
The word "lip" should correctly read "lid".

Column 10, Line 10
The word "canforming" should correctly read "can forming".

Column 10, Line 20
The word "the" should correctly read "a".

Signed and Sealed this
Twelfth Day of July, 2016

Michelle K. Lee

Michelle K. Lee
*Director of the United States Patent and Trademark Office*